US008333489B1

(12) United States Patent
Witte

(10) Patent No.: US 8,333,489 B1
(45) Date of Patent: Dec. 18, 2012

(54) LAMPSHADE SYSTEM FOR RECESSED LIGHTING FIXTURES

(76) Inventor: John Witte, Anchorage, AK (US)

( * ) Notice: Subject to any disclaimer, the term of this patent is extended or adjusted under 35 U.S.C. 154(b) by 229 days.

(21) Appl. No.: 12/804,842

(22) Filed: Jul. 30, 2010

(51) Int. Cl.
*F21V 11/00* (2006.01)

(52) U.S. Cl. ..... 362/351; 362/364; 362/365

(58) Field of Classification Search ..... 362/364, 362/365

See application file for complete search history.

(56) References Cited

U.S. PATENT DOCUMENTS

2002/0196631 A1* 12/2002 Wu ..... 362/351
2008/0113541 A1* 5/2008 Adams ..... 439/236
2008/0158862 A1* 7/2008 Wu ..... 362/150
2008/0186715 A1* 8/2008 Adams ..... 362/310
2009/0310370 A1 12/2009 Carle, Jr.

* cited by examiner

*Primary Examiner* — Evan Dzierzynski
(74) *Attorney, Agent, or Firm* — Michael J. Tavella

(57) ABSTRACT

A shade system that easily attaches to any recessed ceiling fixture. The attachment system has an internal frame structure that allows any size shade to be suspended from it. The shade can be solid, colored, or it can have decorative elements that suit any style. A second modification replaces the normal reflective type bulb used in these fixtures. An adaptor is used so that the user can insert a normal globe style bulb that extends below the ceiling. Using such a bulb, combined with a wide shade converts the spot effect into a diffused warm light throughout the room.

18 Claims, 7 Drawing Sheets

LAMPSHADE SYSTEM FOR RECESSED LIGHTING FIXTURES

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to lampshades for recessed lighting fixtures and particularly to lampshades for recessed lighting fixtures that are flush mounted to the ceiling.

2. Description of the Prior Art

Recessed lighting fixtures have been in use for several decades. These fixtures, often called "cans", are placed in the ceiling. They are secured to the ceiling joists and display their light through a hole in the ceiling material (e.g., plaster or drywall). Typically, these fixtures may have a diffuser placed on the ceiling to give the fixture a finished look, to conceal the internal structure of the fixture, and to diffuse the light. Even with the diffuser, the light from these fixtures tends to be focused in a narrow area and can produce glare.

Referring now to FIG. 1, a typical prior art ceiling fixture 100 is shown. Typically, the fixture has a mounting arm 101 and wiring box 102 and a reflector body 103. The reflector body holds a reflector type light bulb 104. The bottom of the reflector body is designed to rest against the top of a ceiling 105. A diffuser shied 106 may be installed to hide the interior of the reflector body and to help soften the light from the fixture.

There is not much that has been done to change the design style of these fixtures beyond their basic purpose. One change uses special connectors to convert the fixtures into pendent lights. In these cases, the light bulbs are brought down into the room and are covered by a decorative shade. An example of such a device is found in U.S. Pat. No. 7,591,675. Other Examples are found in U.S. Patent Application Nos. 2007/0127234, and 2007/0014118.

Another idea is to add a shade below the fixture. And example of this design is found in U.S. Application No. 2009/0310370. This is a design that attaches a small diameter shade that hangs down from the ceiling. It is flush mounted to the bottom of the ceiling. While it does help the problem of glare, it does have a few problems. First, it has a mounting system that is based on small brackets that are supposed to attach to the fixture with small bolts. Although feasible, the spacing of the brackets is such that it makes it rather difficult to install the shade. It requires working in close quarters with small tools, working overhead. This makes installation difficult. Moreover, because of the attachment design, the diameter of the shade is restricted. It appears that the shade is only slightly wider that the original fixture itself. This does little to remove the problem of focused lighting. Although it does bring the light somewhat more into the room, the small diameter of the shade still creates a "spot light" feel from the fixture.

DESCRIPTION OF THE INVENTION

The instant invention solves all of these problems. It is a shade system that easily attaches to any existing ceiling fixture. The attachment system has an internal frame structure that allows any size shade to be suspended from it. The shade can be solid, colored, or decorated with decorative elements that suit any style. A second modification replaces the normal spot type bulb used in these fixtures. An adaptor is used so that the user can insert a normal globe style bulb that extends below the ceiling. Using such a bulb, combined with a wide shade converts the spot effect into a diffused warm light throughout the room.

DETAILED DESCRIPTION OF THE INVENTION

Figure 1:
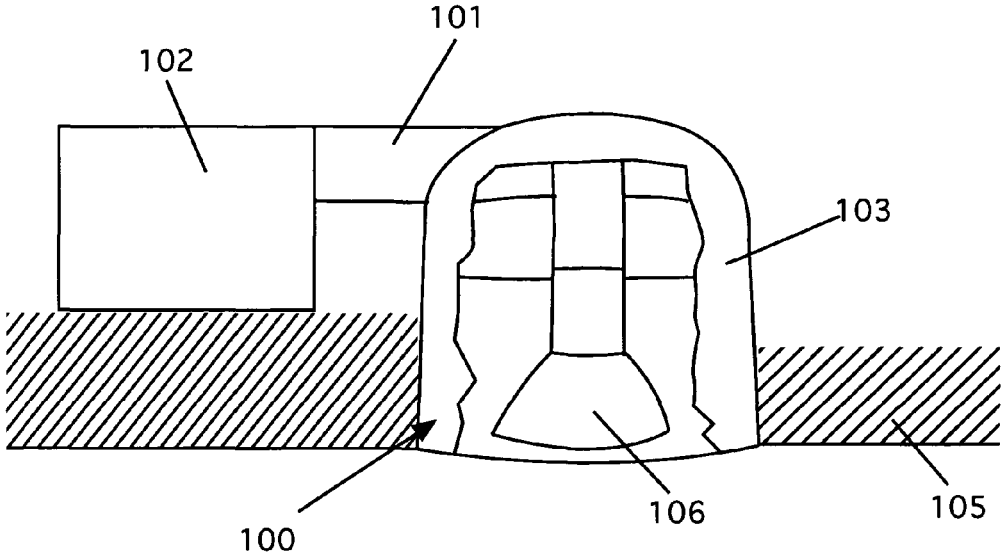
Figure 1 Prior Art
FIG. 1 is a cross-sectional view of a typical ceiling type fixture as prior art.
Figure 2:
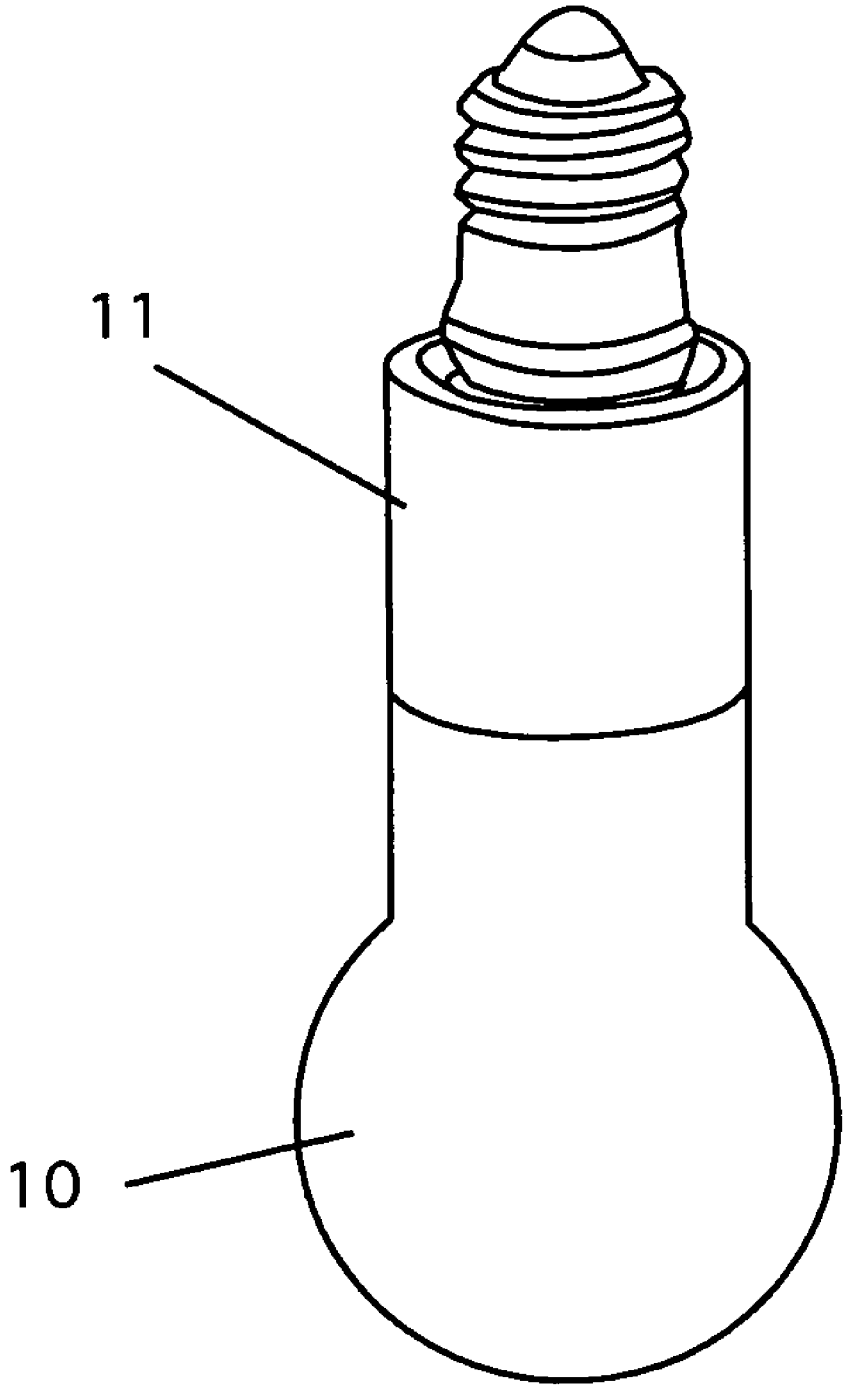
FIG. 2 is a detail view of a light bulb in the extension adaptor.
Figure 3:
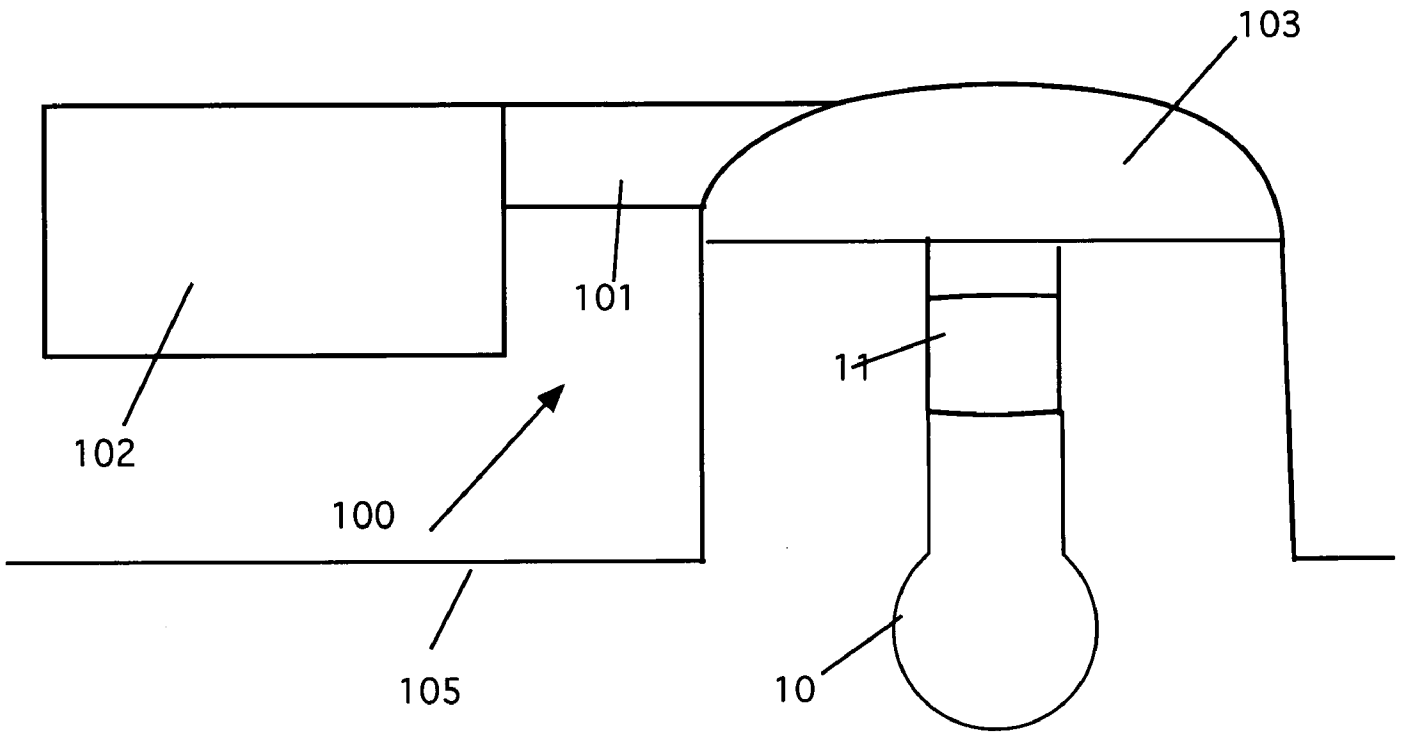
FIG. 3 is a cross-sectional view of a ceiling fixture with the light bulb in the extension adaptor of FIG. 2 installed.

This invention uses a system to attach a shade to existing prior art ceiling fixtures such as those shown in FIG. 1. The system uses a standard bulb 10 instead of the reflector bulb mentioned above. To do this, a bulb extension adaptor 11 is used. These adaptors are commonly available from commercial electrical supply houses. The adapter 11 is screwed into the ceiling fixture and the bulb 10 is then screwed into the adapter. This positions the bulb below the ceiling, which improves the lighting characteristics of fixture when the shade is added. FIG. 3 is a cross-sectional view of a ceiling fixture with the light bulb in the extension adaptor of FIG. 2 installed. As shown, the bulb extends below the ceiling 105.

Figure 4:
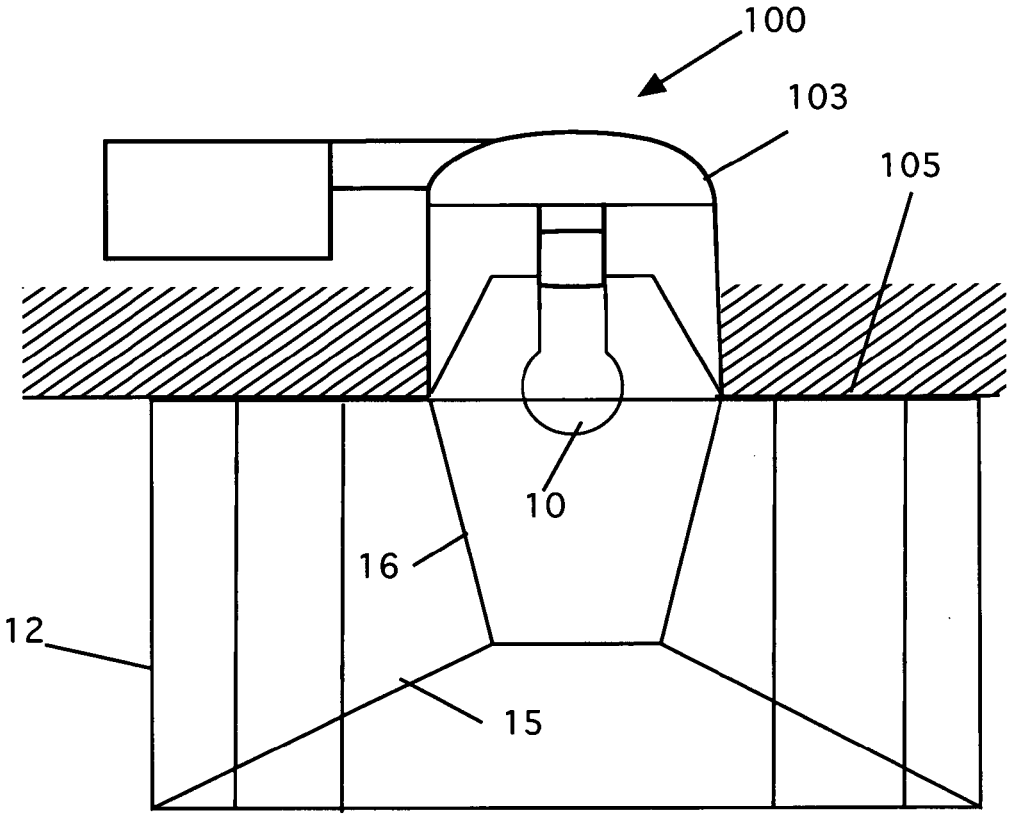
FIG. 4 is a cross-sectional view of the ceiling fixture if FIG. 3 with a wide shade installed.

FIG. 4 is a cross-sectional view of the ceiling fixture of FIG. 3 with a wide shade installed. In this figure, the shade 12 is shown attached to the ceiling fixture. The shade is attached to the fixture so that the top of the shade is flush with the bottom of the ceiling 105. To attach the shade, a framework is installed in the shade. The framework has a lower section 15 that extends to the edge of the bottom of the shade as shown. The lower section extends upward towards the center of the shade. The upper portion of the frame 16 extends upward from the center portion to the top of the shade. This portion has hooks (see below) that attach to the inner rim of the reflector portion. These hooks hold the shade in place.

Figure 5:
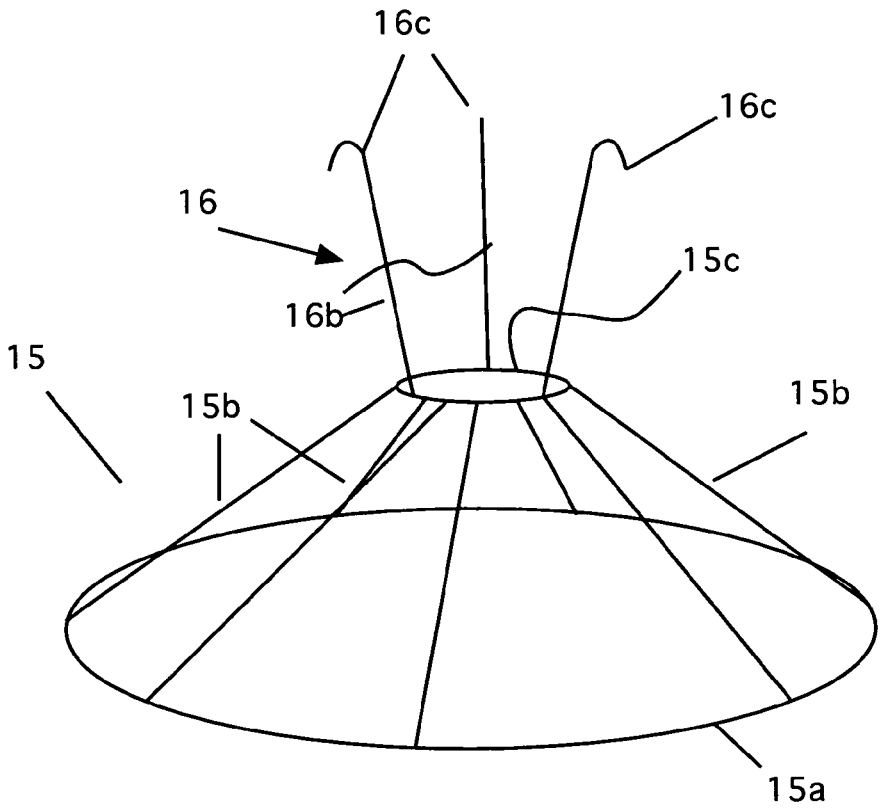
FIG. 5 is a perspective view of the attachment frame without a shade.
Figure 6:
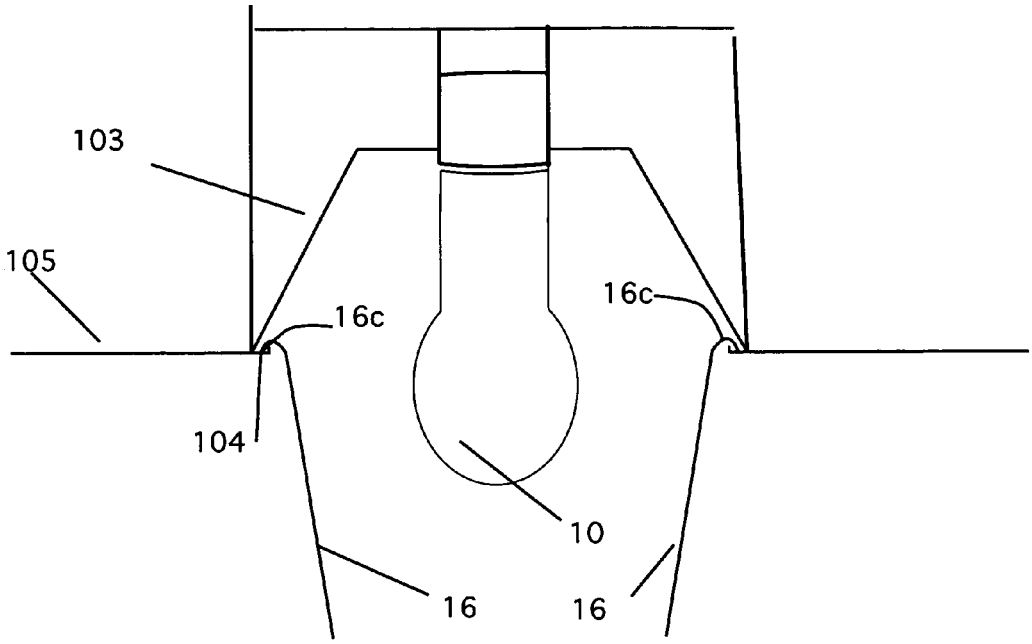
FIG. 6 is a detail view of one of the attachment hooks for the attachment frame.

FIG. 5 is a perspective view of the attachment frame without a shade. Here, details of the frame are shown. The lower portion 15 has a bottom ring 15*a* that attaches to the shade. A number of braces 15*b* extend upward from the bottom ring 15*a* to a center ring 15*c*. The upper portion 16 of the frame consists of at least three arms 16*a* that have, in the preferred embodiment, springs 16*b* that allow the arms 16*a* to flex so that they can be inserted into the fixture. At the top of the arms 16*a* are hooks 16*c* that can be formed by simply bending the top of the arms. The hooks are used to attach the frame to the fixture, are shown in FIG. 6, which is a detail view of the attachment hooks installed in the fixture. At the bottom of the reflector 103 is a lip 104 that normally holds the diffuser. The hooks 16*c* are placed over the lip 104 as shown. Once the hooks are positioned, the shade is attached to the fixture and is secure.

Figure 7:
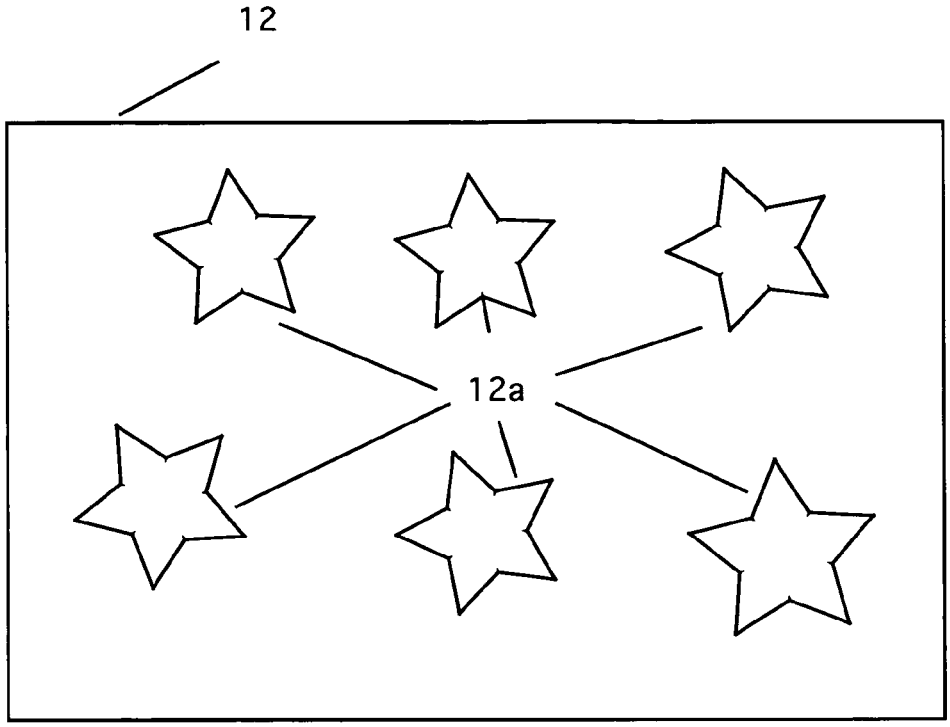
FIG. 7 is a side view of a decorated shade.

As discussed above, the shade can have many different styles—from sold colors to highly decorated shades. These shades can include cut out portions to provide interesting shades. FIG. 7 is a side view of such a decorated shade. In this figure the shade 20 has a number of cut out forms 21 that are positioned around the shade. Of course, the forms can have different shapes as desired. Moreover, the forms can be painted or otherwise attached and need not be cut out.

Moreover, because of the internal frame structure, the diameter of the shade can be substantially larger than the diameter of the recessed light fixture. Thus a shade three or four times wider than the diameter of the shade can easily be suspended form the fixture.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A shade for a recessed light fixture installed in a ceiling comprising:

a) a bulb extension adaptor, screwably engaged in said recessed lighting fixture for holding a non-reflector type light bulb such that said non-reflector type light bulb extends below the ceiling;

b) an elongated shade body having a top end and a bottom end; and c) an internal frame structure, installed in said shade body wherein said internal frame having a means for flush mounting the shade body to said recessed light fixture, such that said shade body extends downward below said ceiling.

2. The shade of claim 1, wherein at least a portion of the shade body has at least one decorative opening therein.

3. The shade of claim 1, wherein the shade body is made of a material selected from the group of glass, paper, and fabric.

4. The shade of claim 1, wherein the internal frame structure includes an attachment mechanism configured to suspend said shade from a rim formed in said recessed lighting fixture.

5. The shade of claim 4, wherein the attachment mechanism includes a plurality of hooks attached to said internal frame structure.

6. The shade of claim 5, wherein the internal frame structure has a lower portion attached to said shade, and an upper portion extending upward from said lower portion.

7. The shade of claim 5, wherein the plurality of hooks on said attached to said internal frame structure are designed to suspend said shade from an internal flange on said recessed fixture.

8. The shade as recited in claim 7, wherein the upper portion of said internal frame structure has a plurality of generally vertical arms, and further wherein each of said vertical arms has a hook formed thereon.

9. The shade of claim 8, wherein the each of said generally vertical arms has a spring installed therein.

10. The shade of claim 1, wherein the shade body is approximately cylindrical in shape and wherein an inner diameter of the shade body is substantially greater than an outer diameter of the flange of the recessed light fixture.

11. A shade for a recessed light fixture comprising:

a) a bulb extension adaptor, screwably engaged in said recessed lighting fixture for holding a non-reflector type light bulb such that said non-reflector type light bulb extends below the ceiling;

b) an elongated shade body having a top end and a bottom end; and c) an internal frame structure including:

i) a lower portion having a bottom ring attached to said shade;

ii) a plurality of riser members attached to said bottom ring;

iii) a top ring, attached to said plurality of riser members;

iv) an upper portion extending upward from said top ring, wherein said upper portion has a plurality of generally vertical arms, and further wherein each of said vertical arms has a hook formed thereon.

12. The shade of claim 11, wherein at least a portion of the shade body has at least one decorative opening therein.

13. The shade of claim 11, wherein the shade body is made of a material selected from the group of glass, paper, and fabric.

14. The shade of claim 11, wherein the internal frame structure is configured to suspend said shade from a rim formed in said recessed lighting fixture.

15. The shade as recited in claim 11, wherein the each of said generally vertical arms has a spring installed therein.

16. The shade of claim 11, wherein each of the hooks on said vertical arms on said internal frame structure are designed to suspend said shade from an internal flange on said recessed fixture.

17. The shade of claim 11, wherein the shade body is approximately cylindrical in shape and wherein an inner diameter of the shade body is substantially greater than an outer diameter of the flange of the recessed light fixture.

18. The shade of claim 11 further comprising a non-reflective type light bulb, installed in said bulb extension adaptor.

* * * * *